US005617800A

United States Patent [19]

Moreschi et al.

[11] Patent Number: 5,617,800

[45] Date of Patent: Apr. 8, 1997

[54] SYSTEM FOR CLEANING FIXTURES UTILIZED IN SPRAY PAINTING

[75] Inventors: Elmer J. Moreschi; Reinhart U. Piuk, both of Kernersville, N.C.

[73] Assignee: Grass America, Inc., Kernersville, N.C.

[21] Appl. No.: 394,146

[22] Filed: Feb. 24, 1995

[51] Int. Cl.[6] ..... B08B 1/02; F23G 5/10

[52] U.S. Cl. ..... 110/236; 432/225; 134/19; 134/38; 15/88.2

[58] Field of Search ..... 110/236; 432/2, 432/75, 224, 225; 134/19, 38; 15/88, 88.1, 88.2, 88.3, 88.4

[56] References Cited

U.S. PATENT DOCUMENTS

| | | | |
|---|---|---|---|
| Re. 33,777 | 12/1991 | Woodroffe | 134/1 |
| 1,416,865 | 5/1922 | Patch | 134/2 |
| 2,118,480 | 5/1938 | Somes | 134/1 |
| 2,221,318 | 11/1940 | Worthing et al. | 392/409 |
| 2,729,191 | 1/1956 | Ransburg | 118/624 |
| 2,730,988 | 1/1956 | Starkey | 118/635 |
| 3,109,439 | 11/1963 | Evans et al. | 134/74 |
| 3,801,369 | 4/1974 | Gregory et al. | 134/19 |
| 3,883,292 | 5/1975 | Hamaker | 432/75 |
| 3,909,289 | 9/1975 | Foucart et al. | 134/2 |
| 3,923,653 | 12/1975 | Lavins, Jr. | 210/769 |
| 3,928,883 | 12/1975 | Gregory et al. | 15/88 |
| 4,069,790 | 1/1978 | Witte | 118/70 |
| 4,137,344 | 1/1979 | Lasne et al. | 427/156 |
| 4,216,369 | 8/1980 | Burtelson | 219/411 |
| 4,394,566 | 7/1983 | Magnusson | 432/224 |
| 4,668,358 | 5/1987 | Ball | 204/489 |
| 4,953,495 | 9/1990 | Salisbury | 118/70 |
| 5,024,597 | 6/1991 | Skolnik et al. | 110/236 |
| 5,026,431 | 6/1991 | Skolnik et al. | 432/225 |
| 5,064,487 | 11/1991 | Fourne | 156/70 |
| 5,133,161 | 7/1992 | Reas | 451/2 |
| 5,233,795 | 8/1993 | Reas | 451/38 |

OTHER PUBLICATIONS

"Induction Heating Equipment & Systems", Tocco Inc., Jan., 1996, pp. 1–12.

*Primary Examiner*—Willis R. Wolfe
*Attorney, Agent, or Firm*—Petree Stockton L.L.P.

[57] ABSTRACT

A method for cleaning a fixture utilized in an electrostatic spray painting process to remove adhered paint particles from the fixture utilizing inductive heating to heat the paint particles to a temperature sufficient to thermally decompose the paint particles to ash and gaseous combustion products. Also disclosed are apparatus for carrying out the method.

7 Claims, 3 Drawing Sheets

SYSTEM FOR CLEANING FIXTURES UTILIZED IN SPRAY PAINTING

FIELD OF THE INVENTION

The present invention relates to a system for removing paint residues and other coatings from fixtures utilized in an conveyor line painting process. More particularly, the present invention comprises a method for cleaning the material hangers utilized in a painting process and an apparatus for use in the method.

BACKGROUND

Electrostatic spray painting, also referred to as powder painting, refers to a process wherein electrically charged paint particles are propelled by compressed air against a metal piece to be painted. The piece being painted is grounded so that it remains electrically neutral. The difference in electrical potential between the paint particles and the piece being painted causes the paint particles to adhere to the piece. The piece is then heated to more permanently affix the paint particles.

In a typical conveyor line painting process, the pieces to be painted are carried by the conveyor line through an electrostatic spray painting station which includes the painting equipment and heating equipment. The pieces to be painted are hung from metal hangers on the conveyor line, thereby electrically Founding the piece. The piece to be painted, and a portion of the hanger contacting the piece, travel through the painting station and are electrostatically spray painted. The painted piece and portion of the hanger are then heated to more permanently affix the paint particles to the piece. These painting and heating steps also result in paint particles becoming affixed to the portion of the hanger which travels through the painting station.

After the heating step, the painted piece is removed from the hanger for further conveyor work or packaging. Generally, the hanger remains affixed to the conveyor line and is used to carry additional pieces through the painting station. After several passes through the painting station, the portion of the hanger on which the piece is hung becomes coated with layers of paint. The build-up of paint prevents an electrically clean contact between the hanger and the piece being painted and, therefore, interferes with the proper grounding of the piece being painted. Problems arising in connection with insufficient grounding of the piece to be painted include bad turn in, uneven distribution of the paint a high consumption of paint and spark formation.

In order to overcome the problems associated with poor grounding of the pieces being painted, resulting from a build-up of paint on the hangers, a new hanger may be utilized for each painting operation. However, this solution is disadvantageous since the cost of new hangers would make many painting processes uneconomical and also because the need to hang new hangers on the conveyor line could interrupt the continuous nature of the painting process.

The disadvantages of paint build-up on hangers used in electrostatic spray painting is a problem which is well recognized in the art. For this reason, conveyor line operators periodically remove paint from the hangers in accordance with good housekeeping principles, and to forestall interference with line operation. However, the currently utilized procedures for removing paint from hangers can be expensive, cumbersome, slow and difficult.

For example, in one prior art method, paint built up on the hangers is removed by immersing the hangers in a tank of solvent to dissolve the paint. The labor to take down the hangers in this process is expensive. The solvents are likewise expensive and present disposal and and safety problems. Moreover, the dissolving process may require four to five hours. Since, it may be uneconomical to shut down the conveyor line for that period of time, it is necessary to keep a complete spare set of hangers to put on the line during cleaning, increasing both labor and equipment costs.

In order to overcome these problems, methods have been proposed for continuously cleaning the hangers used in an conveyor line electrostatic painting process, in a cleaning station forming part of the conveyor line. One such cleaning station is described in U.S. Pat. No. 3,830,196. In the system disclosed in the U.S. Pat. No. 3 196, hangers uses to suspend articles from a conveyor for transport through a continuous painting line are cleaned of accumulated paint by burning the paint to ash in an oven and spray washing to remove the ash. The burning and spray washing occur in a cleaning station located downstream of the electrostatic spray painting booth in the conveyor line. Unfortunately, a cleaning station such as the one envisioned by the U.S. Pat. No. '196 may be very energy consuming. In addition, the length of the furnace and consequently also the cost of its manufacture, is dependent on the speed of which the conveyor line travels and the size of the hangers on the line.

Another method for the continuous cleaning of hangers utilized in electrostatic spray painting processes is disclosed in U.S. Pat. No. 4,069,790. The process disclosed in the U.S. Pat. No. '790 utilizes heating filaments disposed within each of the hangers. The heating filaments are heated in a heating station located downstream of the electrostatic spray painting booth in order to cause residual paint left on the hangers to be burned off. Unfortunately, the preparation of hangers containing heating elements may prove uneconomical for many applications.

Accordingly, there remains a need for a system for cleaning the hangers utilized in an electrostatic spray painting process, which will clean the hangers in an economical fashion with minimal disruption to the conveyor line process.

SUMMARY OF THE INVENTION

The present invention provides a system for cleaning the fixtures, such as hangers, utilized in an electrostatic spray painting process that meets the aforementioned need and avoids or minimizes the disadvantages of the prior art systems discussed above. According to the present invention, a method for cleaning fixtures utilized in an electrostatic spray painting process, to remove adhered paint particles from the fixtures, comprises: inductively heating a portion of the fixture comprising adhered paint particles to a temperature sufficient to thermally decompose the paint particles to ash and gaseous combustion products. As used herein, induction heating refers to the heating process wherein the temperature in a material is increased by induced electric current. Induction heating is also referred to as eddy-current heating.

Typical fixtures utilized for suspending pieces to be painted include hangers and the like. Although in the following description the system of the present invention is described with reference to hangers, it should be understood that the system of the present invention is not limited to use with hangers, but instead may be utilized with other fixtures.

In the process and apparatus of the present invention described hereafter, induction heating is utilized to heat a portion of a fixture, or hanger, having adhered paint particles. In order for induction heating to be effective, the portion of the fixture being heated should comprise a ferromagnetic material. The heating of the fixture portion (hanger portion) will indirectly heat paint particles adhering to the fixture and cause the paint particles to bum, and otherwise thermally decompose, to ash and gaseous combustion products. If the paint, or other substance adhered to the fixture, contains ferromagnetic material it is possible that the means utilized for induction heating may also directly heat the adhered paint particles.

In an conveyor or conveyer line process, the means for induction heating may be placed in the conveyor line downstream of the station where the painted parts are removed from the hangers. The means for induction heating may be configured and arranged such that the hangers will travel past the heating means which will locally heat the portion of the hanger that has traveled through the painting equipment and needs to be cleaned. Adhered paint is burned off, providing an electrically clean contact point for attachment of the next part to be painted.

As set forth above, the thermal decomposition of the paint will produce ash and gaseous combustion products (fumes). Preferably, the process of the present invention further comprises a step of collecting the gaseous combustion products (fumes) produced in the thermal decomposition of the paint. The collection means may comprise vacuum equipment or other conventional air handling equipment. Generally it will preferable to collect a substantial majority, more preferably substantially all, of the gaseous combustion products to prevent the escape of any potentially hazardous or toxic fumes to the environment. The collection means may further comprise means for purifying and recycling the collected fumes back into the work place environment. The purification means may include conventional filters and scrubbers and the like. As will be recognized by those of ordinary skill in the art, the composition of the gaseous combustion products, and their suitability for purification and recycling back into the work place, will depend on the type of paint utilized in the painting process, in particular to the chemical composition of the paint.

Ash that remains on the hanger that may be removed and collected by cleaning (ash removal) means such as brushes or the like. Thus, in a preferred embodiment of the invention, the process of the present invention further comprises the step of removing ash and other solid combustion byproducts produced by the thermal decomposition of the adhered paint, from the hanger.

It is also possible to remove ash that remains on portion of the hanger that has been heated with equipment other than brushes, or equipment that may be utilized in conjunction with brushes. For example, the ash, since it will generally be loosely connected to the hanger, may be removed by an air blast or by mechanically agitating or vibrating the hanger. Ultrasonic cleaning may also be utilized. The choice of cleaning (ash removal) means will generally be made in consideration of both cleaning efficiency and cost.

Ash and solid products removed from the hanger may be collected for future disposal. The means for collecting the ash and solid products may include, or form a part of, the collection means utilized to collect the gaseous combustion products. The means for collecting the ash may comprise a vacuum or other similar device. It is also possible to let the removed ash fall into a tray or pan located beneath the cleaning (ash removal) means.

During the induction heating step and/or subsequent cleaning step(s) of the process of the present invention, it will often be desirable to stabilize the hangers as they pass through the induction heating means and/or cleaning (ash removal) means. The hangers may also be stabilized at other points on the conveyer line.

In this context, stabilization refers to minimizing the swaying or other movement of the hangers as they hang from and are moved by the conveyer line. Stabilizing the hanger will prevent contact between the hanger and the induction heating means, and will also minimize the possibility of hangers being knocked off the conveyer line by the cleaning (ash removal) means. Thus, the process of the present invention may further include stabilizing the fixtures (hangers) being heated and/or cleaned.

The stabilization means may comprise wheels, belts, guide rails, combinations thereof and the like, which prevent the swaying of the hanger. Preferably, the stabilization means comprise moving belts, disposed on each side of the hanger and located beneath the conveyer line and above the portion of the hanger to be heated and/or cleaned.

As will be explained in more detail below, the induction heating means, brushes, equipment for removing and collecting ash and/or gaseous combustion products brushed or driven off the hanger, and stabilization means may collectively form a hanger cleaning station on the conveyer line.

As will be realized from the foregoing description, in the system of the present invention an apparatus for removing adhered paint particles from hangers comprises:

induction heating means; and means for passing a portion of the hanger, comprising adhered paint particles, sufficiently close to, and/or through, the induction heating means, for a sufficient period of time, such that the paint particles are heated to a temperature sufficient to thermally decompose the paint particles to ash and gaseous combustion products. Ideally the portion of the hanger is heated in as short a time period as possible, to thereby keep the size of the induction heating means to a minimum.

The conveyer line may be utilized as means for passing the portion of the hanger close to the induction heating means. Thus, an apparatus of the present invention may simply comprise induction heating means for heating a portion of a hanger, comprising adhered paint particles to a temperature sufficient to thermally decompose the paint particles to ash and gaseous combustion products.

In a preferred embodiment, the apparatus for removing adhered paint particles from hangers further comprises:

cleaning (ash removal) means for removing ash from the hangers; and means for passing the portion of the hanger, comprising ash produced by the burning of the adhered paint particles, sufficiently close to the cleaning (ash removal) means such that the cleaning (ash removal) means remove a substantial portion, preferably substantially all, of the ash from the hanger. Preferably the apparatus further comprises means for containing and collecting the ash or dust generated in the cleaning process.

The apparatus of the present invention may further comprise one or more of the following features:

means for collecting the gaseous combustion products produced from the thermal decomposition of the adhered paint and/or airborne particles produced from the cleaning process.

means for stabilizing the hangers during the heating and/or cleaning processes.

Further details relating to the system of the present invention, including the methods and apparatus of the present invention, are set forth below the following more detailed description. Although the system of the present invention is described herein with reference to cleaning the hangers utilized in an electrostatic painting process, it will should be recognized that the present invention is not limited to use in an electrostatic painting process and may be utilized to clean parts, or portions of parts, or part hangers, utilized in other processes, particularly other painting or coating processes.

The system of the present invention, comprising the methods and apparatus of the present invention, has many advantages including the following:

i) in an conveyor line process the hangers do not need to be removed from the conveyer line to be cleaned;

ii) suitable induction heating means for burning off the paint particles are relatively small, in comparison to conventional burners, and thus the hanger cleaning station does not take up much floor space in the factory;

iii) the use of the induction heating provides an environmentally sound method of removing the paint residue that does not rely on the use of solvents and harsh chemicals that require special handling for disposal; and iv) induction heating provides a localized source of energy which results in the quick heating of a very specific portion of the hanger while the remainder of the hanger remains relatively cool, and additionally results in the quick cooling of the heated portion of the hanger, both of which permit new parts to be hung from the hanger quickly after the hanger has been cleaned.

DETAILED DESCRIPTION OF THE INVENTION

Further details relating to the present invention are set forth in the following paragraphs with reference to FIGS. 1–5.

Figure 1:
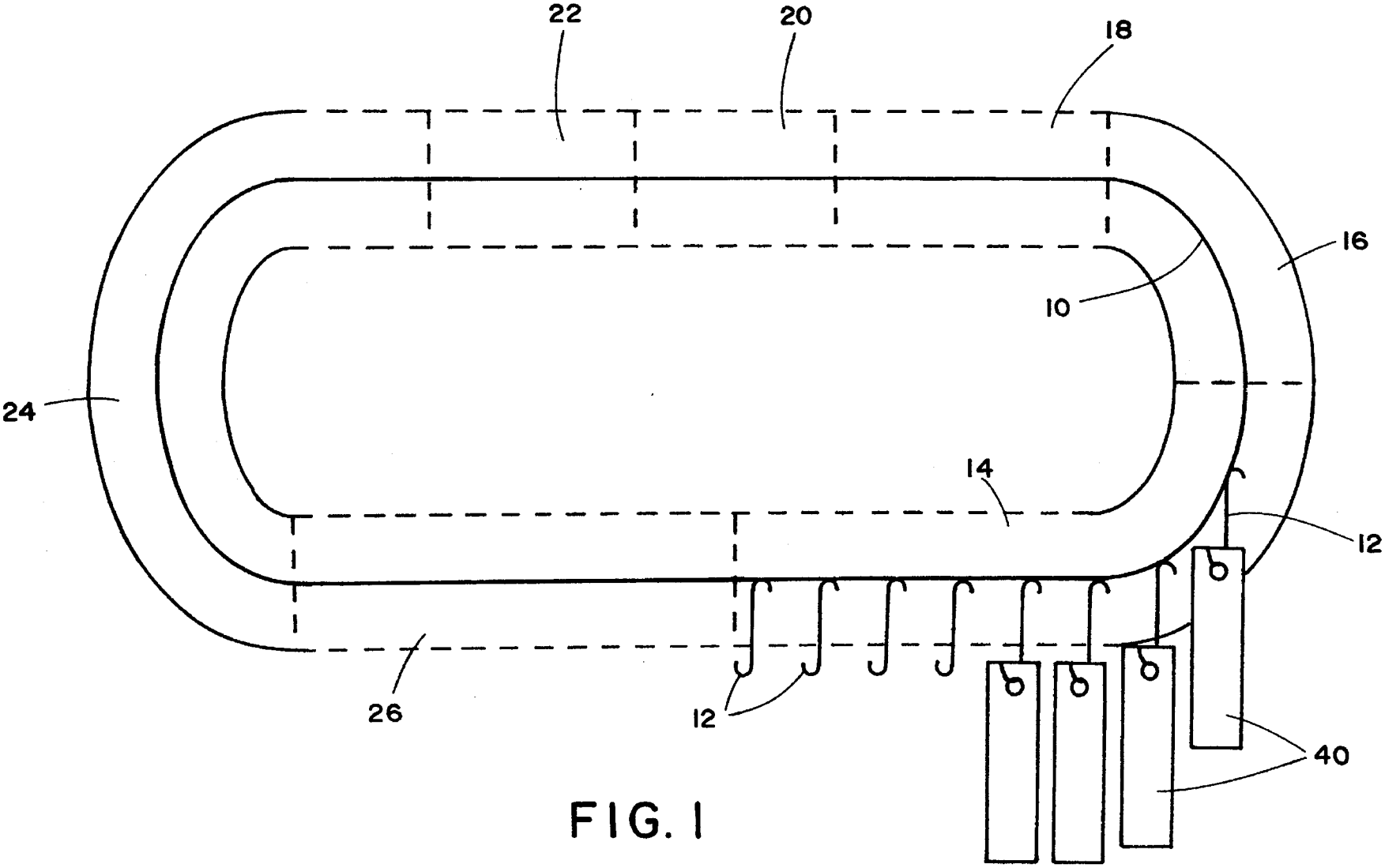
FIG. 1 is a schematic illustration of a continuous painting line.

FIG. 1 illustrates a typical continuous electrostatic painting line. As shown in FIG. 1, conveyer line 10 is adapted to carry hangers 12. For the sake of clarity, only several hangers are shown in FIG. 1, although in an actual painting line there would be hangers hung around the entire circumference of the conveyer line.

Conveyer line 10, continually circles in one direction, as shown by the arrow in FIG. 1. In a continuous painting process, a series of zones exists around the conveyer wherein pieces to be painted are loaded onto the hangers, painted and then removed from the hangers after painting. In the system of the present invention, a zone is also provided for cleaning the hangers, while the hangers remain suspended from the conveyer line.

The sequence of zones includes a loading zone, 14, where pieces (articles) to be painted, 40, are loaded onto hangers, 12. Depending on the pieces to be painted, the conveyer line may include a pretreatment zone 16, wherein the pieces are pre-treated prior to painting. Many different types of chemical pretreatments are conventionally utilized depending on the severity of the service the paint coat on the painted piece will experience. A pretreating station generally comprises, one or more cleaning means, one or more rinsing means, one or more phosphating rinses, one or more fixing rinses and a dry-off station. The chemical pretreatment may be dispensed through the rinsing means.

After loading, and pretreatment, if any, the hangers and suspended pieces travel through painting zone 18, wherein the pieces are electrostatically spray painted. The electrostatic painting equipment is generally designed so that the entire piece to be painted is suspended within a painting booth, wherein electrostatically charged paint particles are propelled against the piece. It is preferred that a majority of the hanger holding the piece, and the conveyer line, remain outside the painting booth. However, it is generally necessary for a portion of the bottom of hanger, in close proximity to the suspended piece, to travel through the painting booth to ensure that the entire surface of the piece is painted. As set forth in the foregoing background section, the portion of the hanger which travels through the painting booth with the suspended piece becomes coated with paint particles and needs to be cleaned to ensure sufficient electrical communication between the hanger and the piece, so that the piece remains grounded during painting.

After traveling through the painting zone, the hangers and suspended pieces pass through heating/drying zone 20, wherein the paint is substantially permanently affixed to the piece. Next the hangers and pieces travel through cooling zone 22. When the painted pieces are sufficient cool to be handled, they are removed from the hangers in unloading zone 24.

The cleaning system of the present invention is advantageously located alter the unloading zone, in cleaning zone 26. In this manner, hangers will be cleaned, and substantially free of paint residue prior to the loading of additional pieces to be painted.

It should be noted that the zones in FIG. 1, and described above, are not shown, nor intended to be shown, to scale. The relative size of each of the zone will be determined by the length and size of the conveyer line, and the nature of the piece to be painted. It is believed such determinations are within the skill of those of ordinary skill in the art.

Figure 2:
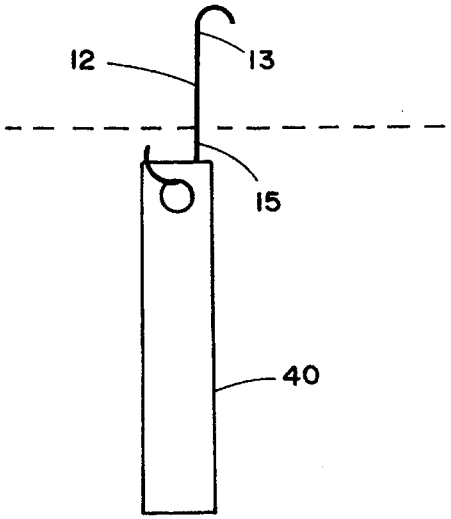
FIG. 2 is an illustration of a hanger and a piece to be painted.

FIG. 2 illustrates hanger 12, having a portion 13, for attaching hanger 12 to the conveyer line, and portion 15 for suspending a piece to be painted. In FIG. 2, piece 40 is shown suspended from hanger 12. As shown by the dotted line, portion 15 of hanger 12 near piece 40, would generally pass through the inside of a painting station in the painting zone and therefore be coated with paint. Portion 15 of hanger 12 would also generally pass through the inside of heating means in the heating zone, therefore the paint would become affixed to portion 15. Piece 40 would also pass through the inside of the painting station and the heating station and become painted. The remainder of hanger 12, including portion 13, would generally remain outside both the painting station and the heating station and therefore remain substantially free of affixed paint.

Figure 3:
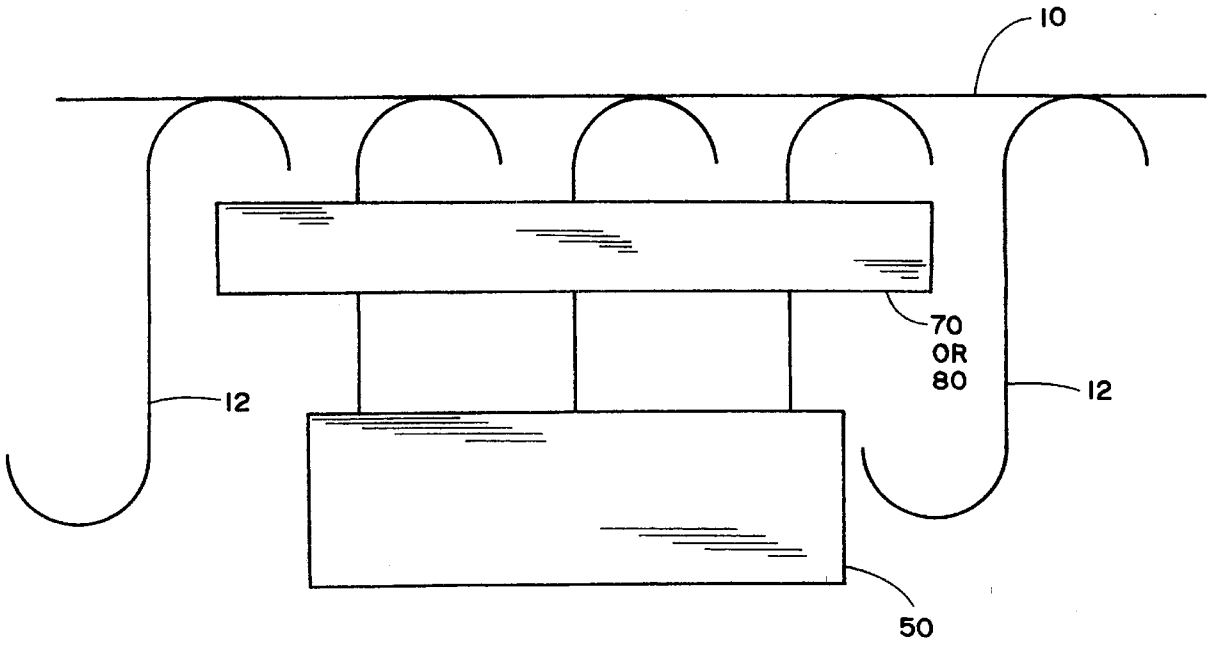
FIG. 3 is an illustration of a cleaning station in a continuous painting line, according to the present invention.

FIG. 3 illustrates, in side view, a possible embodiment of an apparatus of the present invention utilized in a conveyer line. As shown in FIG. 3, induction heating means 50, may be configured so that portion 15 of hanger 12, passes sufficiently near, or through, the induction heating means while hanger 12 remains suspended from conveyer line 10. Stabilizing means, which in FIG. 3 comprise belt 70 or 80, may be utilized to minimize the swaying of the hangers as they pass through the induction heating means. As explained in more detail below, the stabilizing means may be located locally at the induction heating means and/or the cleaning (ash removal) means for removing any ash adhered to the hanger after heating, or may be configured to extend continuously from the induction heating means past the cleaning (ash removal) means.

Figure 4:
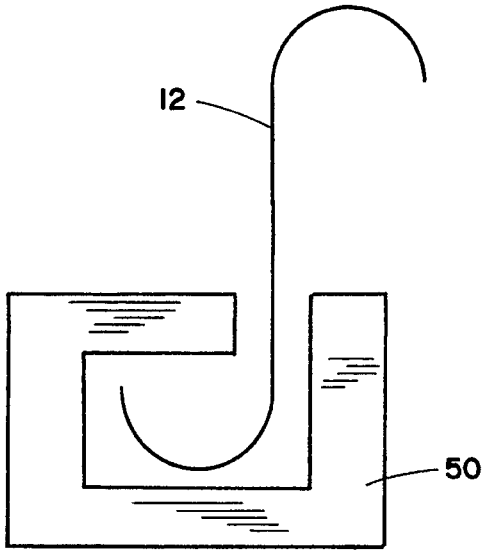
FIG. 4 is a side view of a hanger and induction heating means.

Induction heating means 50 is shown in side cut-away view in FIG. 4. As shown in FIG. 4, induction means 50 may be preferably configured so that the heating means surround portion 15, of hanger 12. As will be recognized by those of ordinary skill in the art, there are many possible variations in the configuration of the induction heating means which are suitable for use in the system of the present invention. Generally, the design of the hanger will determine the optimal design configuration of the induction heating means. As set forth above, it is preferred the induction heating means heat the portion of the hanger, and adhered paint particles, to a temperature sufficient to decompose the paint particles, in ass short as time as possible in order to aninimize the size (length along the conveyer line) of the induction heating means.

Induction heating means suitable for use in the system of the present invention include high frequency induction heating coils with appropriate power supply, and the like. The induction heating means utilized should be sufficient to heat the adhered paint particles, and the portion of the hanger having the adhered paint particles, to a temperature sufficient, and for a time sufficient, to cause substantially all of the adhered paint to bum or decompose to ash, without damaging the hanger. Generally, for the types of electrostatic spray paints which are currently utilized, the induction heating means should heat the portion of the hanger comprising the adhered paint particles to a temperature of 1000° to 1600° F., preferably 1100° to 1400° F., more preferably 1200° to 1300° F. The heating of the hanger portion to this temperature is preferably accomplished within 2 to 5 seconds, preferably within 2 to 3 seconds, more preferably in about 2.5 seconds. As will be understood by those in the art, the particular temperatures utilized will depend on the type electrostatic spray paint utilized in the painting process, as well as the thickness of the adhered paint layer. Where cleaning (ash removal) means are utilized in combination with the induction heating means, the temperatures should be sufficient to cause sufficient thermal decomposition of the adhered paint so that it may be removed by the cleaning (ash removal) means. Preferably, the temperatures utilized should cause the thermal decomposition of the adhered paint to ash and gaseous combustion products.

Preferably, smoke and other gaseous combustion products generated by the burning off of the paint particles are collected by conventional air and dust handling equipment and vented to the atmosphere, or otherwise disposed of, in a manner consistent with environmental and work place safety regulations. In a preferred embodiment of the present invention, the air and dust handling equipment are part of a combined cleaning station which comprises the induction heating means and cleaning (ash removal) means for removing any ash adhered to the hanger.

In a preferred embodiment of the system of the present invention, wherein the induction heating means are employed as a cleaning zone along a conveyer line, the time period in which the adhered paint, and hanger portion, are heated may be adjusted by varying the size (length) of the induction heating means along the axis of travel of the conveyer line. The time period of heating will also depend on the speed at which the hangers travel through the cleaning station, which is in turn dependent on the speed of the conveyer line.

Figure 5:
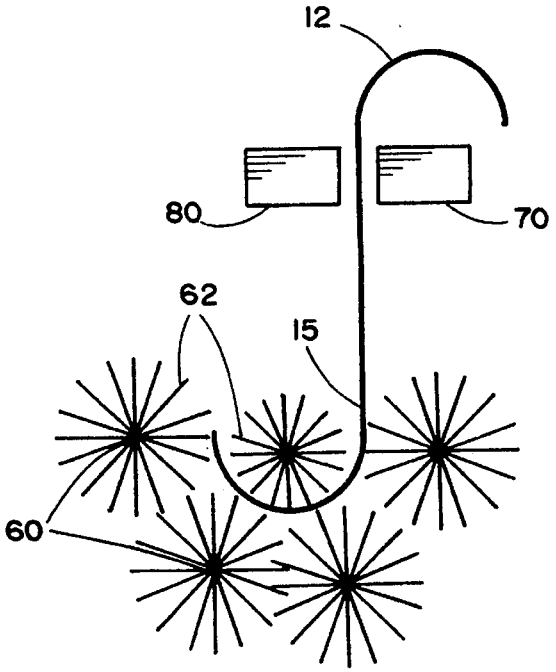
FIG. 5 is a representation of one possible means for removing ash from a hanger.

As set forth above, the system of the present invention may also include cleaning (ash removal) means for removing any residual ash remaining on the hangers after the paint particles are substantially burned off. As illustrated in FIG. 5, the cleaning (ash removal) means may comprise brushes, 60, or the like, arranged such that the brush bristles, 62, contact portion 15, of hanger 12 containing ash. The number of brushes utilized, and their arrangement are adapted to ensure substantially all of the ash is removed from the contact portion 15, of hanger 12. The brushes may comprise wire brushes, nylon brushes, or the like. Stabilizing means, which in FIG. 5 comprise belts 70 and 80 may be utilized to minimize the swaying of the hangers, and to help prevent the brushes 60 and brush bristles 62 from knocking the hanger from the conveyer line. The cleaning (ash removal) means may be located immediately downstream of the induction heating means. Although not illustrated in FIG. 5, ash removed from the hangers may be collected by conventional dust handling equipment, such as conventional vacuum equipment.

Figure 6:
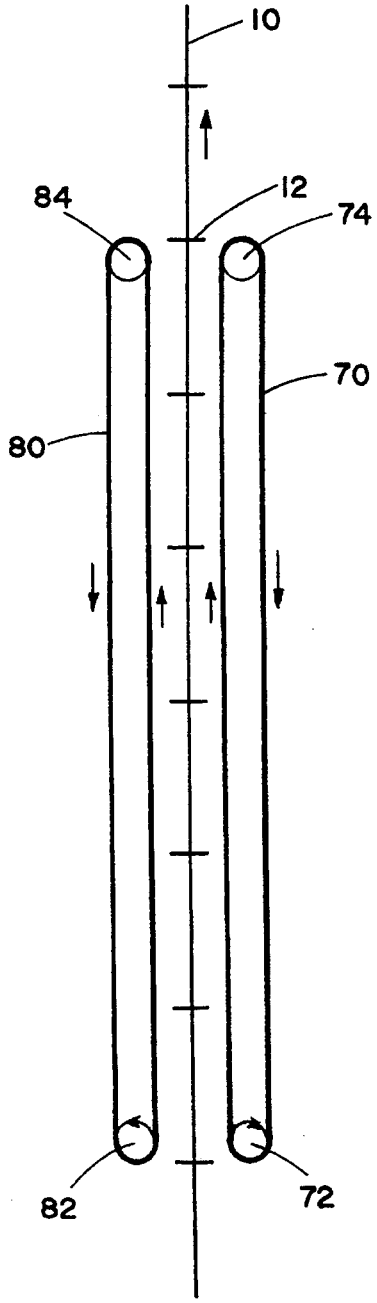
FIG. 6 is a top view of one possible means for stabilizing hangers.

One possible embodiment of stabilizing means, suitable for use in the present invention is illustrated in FIG. 6. As illustrated in top view, the stabilizing means may comprise belts 70 and 80 disposed on either side of the conveyor line, 10 and hangers 12. As illustrated in FIGS. 3 and 5, belts 70 and 80 are preferably located between conveyer line 10 and the induction heating means and/or cleaning (ash removal) means. It is preferred that the section of each belt nearest the conveyer line move at a speed approximately equal to the speed of the conveyer line, in the same direction as the conveyer line. The movement of each belt 70 and 80, and the conveyer line 10 are illustrated by the arrows in FIG. 6.

As further illustrated in FIG. 6, belt 70 may be disposed to travel around pulleys, or gears, 72 and 74; and belt 80 may be disposed to travel around pulleys, or gears, 82 and 84. A motor or motors (not shown) may be utilized to drive pulley 72 and/or 74, and to drive pulley 82 and/or 84 to thereby move the belt. The motor, or motors, are preferably located such that interference between the motor, or motors, and the conveyer line and/or the induction heating and/or cleaning (ash removal) means is minimized.

Although one possible embodiment of stabilizing means is illustrated in FIG. 6, other embodiments and configurations are possible. For example, the stabilizing means may comprise wheels or gears instead of a belt.

As will be understood from the foregoing description, many modifications of the system of the present invention may be made without departing from the spirit of the invention.

For example, hangers with coatings other than paint, as well as hangers or fixtures coated in other types of electric processes, for example electrophoretic processes, or non electric processes may be advantageously cleaned through the use of induction heating in the manners described herein provided the coatings are burnable to form combustion product gas and residue. In addition, the arrangement of the induction heating means, and its location in the conveyor line may be varied to accommodate different processes.

Thus, it should be clearly understood that the forms of the present invention herein described are illustrative only and are not intended to limit the scope of the invention.

We claim:

1. An apparatus for removing adhered paint particles from a fixture comprising:

induction heating means; and means for passing a portion of the fixture, comprising adhered paint particles, sufficiently close to the induction heating means such that the paint particles are heated to a temperature sufficient to thermally decompose the paint particles to ash and gaseous combustion products.

2. The apparatus of claim 1 further comprising:

cleaning means for removing ash from the fixtures; and means for passing the portion of the fixture, comprising ash produced by the burning of the adhered paint particles, sufficiently close to the cleaning means such that the cleaning means remove a substantial portion of the ash from the fixture.

3. The apparatus of claim 1 further comprising:

means for stabilizing the fixture while the fixture is passed by the induction heating means.

4. The apparatus of claim 1 wherein the means for passing the portion of the fixture close to the induction heating means comprises a conveyer line.

5. The apparatus of claim 3 wherein the inductive heating means heat the fixture to a temperature of 1000° to 1600° F.

6. A conveyer line for electrostatic spray painting comprising the apparatus of claim 1.

7. The apparatus of claim 1 wherein the means for induction heating is configured to locally heat the portion of the fixture to be cleaned.

* * * * *